US006871460B1

(12) United States Patent
Nelson

(10) Patent No.: US 6,871,460 B1
(45) Date of Patent: Mar. 29, 2005

(54) RESTROOM STALL BARRIER DEVICE

(76) Inventor: Matthew T. Nelson, 8819 Blairwood Rd., Apt. T2, Baltimore, MD (US) 21236

( * ) Notice: Subject to any disclaimer, the term of this patent is extended or adjusted under 35 U.S.C. 154(b) by 144 days.

(21) Appl. No.: 10/434,633

(22) Filed: May 12, 2003

(51) Int. Cl.[7] ..... E04H 1/00
(52) U.S. Cl. ..... 52/239
(58) Field of Search ..... 52/239, 243, 238.1, 52/34, 36.1; 160/40; 49/50, 54

(56) References Cited

U.S. PATENT DOCUMENTS

| | | | | |
|---|---|---|---|---|
| 2,122,532 A | | 7/1938 | Mims et al. | |
| 3,170,200 A | | 2/1965 | Araas | |
| 5,018,302 A | | 5/1991 | Kluge | |
| 5,458,178 A | | 10/1995 | Nakamura | |
| 5,657,581 A | * | 8/1997 | Husting | 49/409 |
| 5,768,827 A | | 6/1998 | Hackett | |
| 5,852,837 A | * | 12/1998 | Husting | 4/607 |
| 5,893,181 A | * | 4/1999 | Moncaster | 4/557 |
| 5,927,011 A | | 7/1999 | Sickenius | |
| 6,023,889 A | * | 2/2000 | Husting et al. | 52/35 |

FOREIGN PATENT DOCUMENTS

| | | | | |
|---|---|---|---|---|
| GB | 2266735 A | * | 11/1993 | A47K/4/00 |

* cited by examiner

*Primary Examiner*—George Chan
*Assistant Examiner*—A. Joseph Wujciak, III

(57) ABSTRACT

A restroom stall barrier device for preventing children from locking the door and crawling out of the stall beneath the side walls or the door. The restroom stall barrier device includes a restroom stall including support members and also including side walls being mounted to the support member and further including a door being hingedly attached to one of the side walls with the side walls and the door being suspended above a floor; and also includes barrier members being fastened to the side walls and the door.

6 Claims, 3 Drawing Sheets

RESTROOM STALL BARRIER DEVICE

BACKGROUND OF THE INVENTION

1. Field of the Invention

The present invention relates to restroom stall barriers and more particularly pertains to a new restroom stall barrier device for preventing children from locking the door and crawling out of the stall beneath the side walls or the door.

2. Description of the Prior Art

The use of restroom stall barriers is known in the prior art. More specifically, restroom stall barriers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,122,532; U.S. Pat. No. 5,018,302; U.S. Pat. No. 5,927,011; U.S. Pat. No. 5,458,178; U.S. Pat. No. 3,170,200; and U.S. Pat. No. 5,768,827.

While these devices fulfill their respective, particular objectives and requirements, the aforementioned patents do not disclose a new restroom stall barrier device. The prior art includes grates being attached to windows and are used to cook foods thereupon.

SUMMARY OF THE INVENTION

The general purpose of the present invention, which will be described subsequently in greater detail, is to provide a new restroom stall barrier device which has many of the advantages of the restroom stall barriers mentioned heretofore and many novel features that result in a new restroom stall barrier device which is not anticipated, rendered obvious, suggested, or even implied by any of the prior art restroom stall barriers, either alone or in any combination thereof. The present invention includes a restroom stall including support members and also including side walls being mounted to the support member and further including a door being hingedly attached to one of the side walls with the side walls and the door being suspended above a floor; and also includes barrier members being fastened to the side walls and the door. None of the prior art includes the combination of the elements of the present invention.

There has thus been outlined, rather broadly, the more important features of the restroom stall barrier device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new restroom stall barrier device which has many of the advantages of the restroom stall barriers mentioned heretofore and many novel features that result in a new restroom stall barrier device which is not anticipated, rendered obvious, suggested, or even implied by any of the prior art restroom stall barriers, either alone or in any combination thereof.

Still another object of the present invention is to provide a new restroom stall barrier device for preventing children from locking the door and crawling out of the stall beneath the side walls or the door.

Still yet another object of the present invention is to provide a new restroom stall barrier device that is easy and convenient to install.

Even still another object of the present invention is to provide a new restroom stall barrier device that prevents empty stalls from being locked and not usable as a result.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
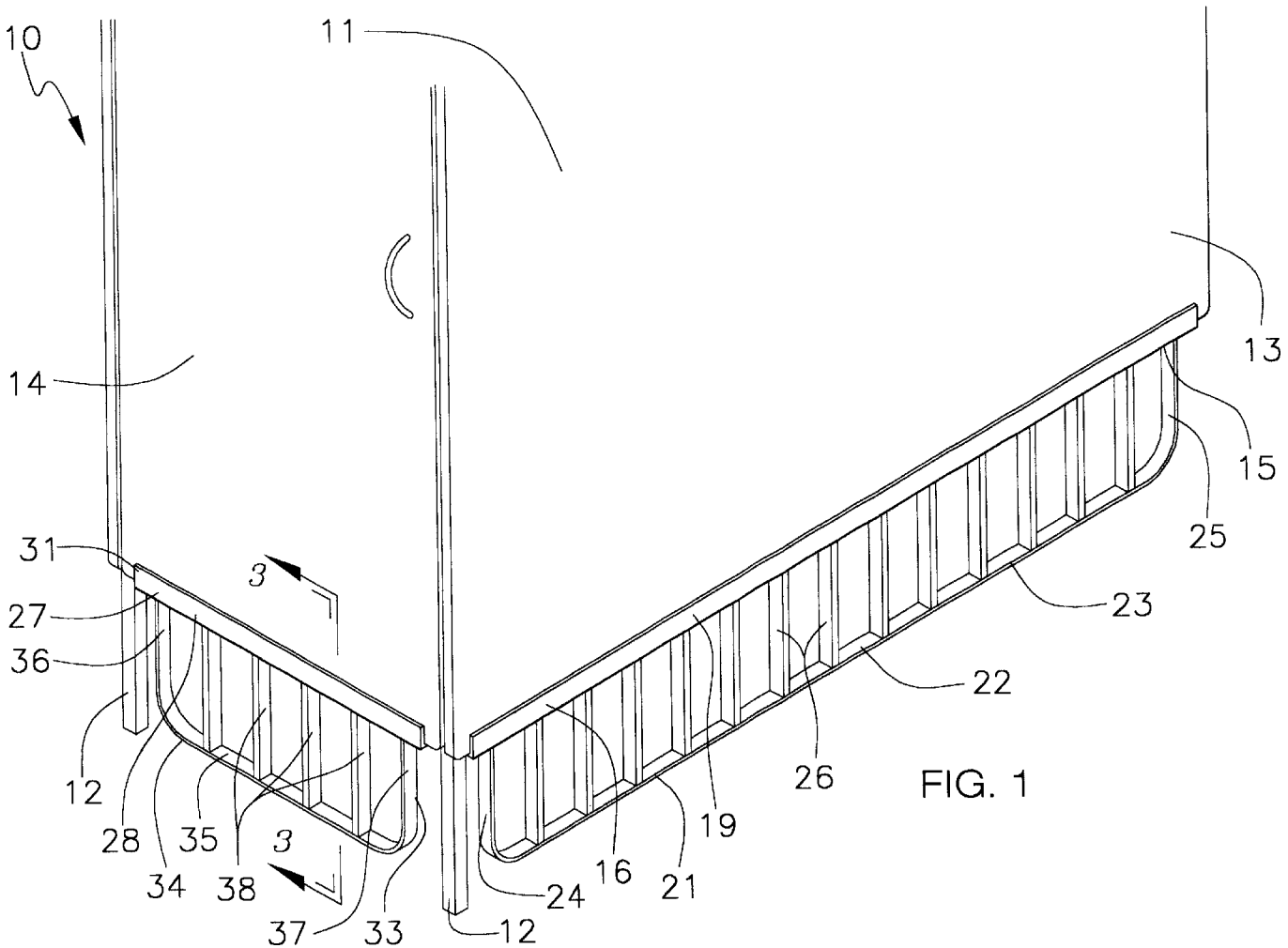
FIG. 1 is a perspective view of a new restroom stall barrier device according to the present invention and shown in use.
Figure 2:
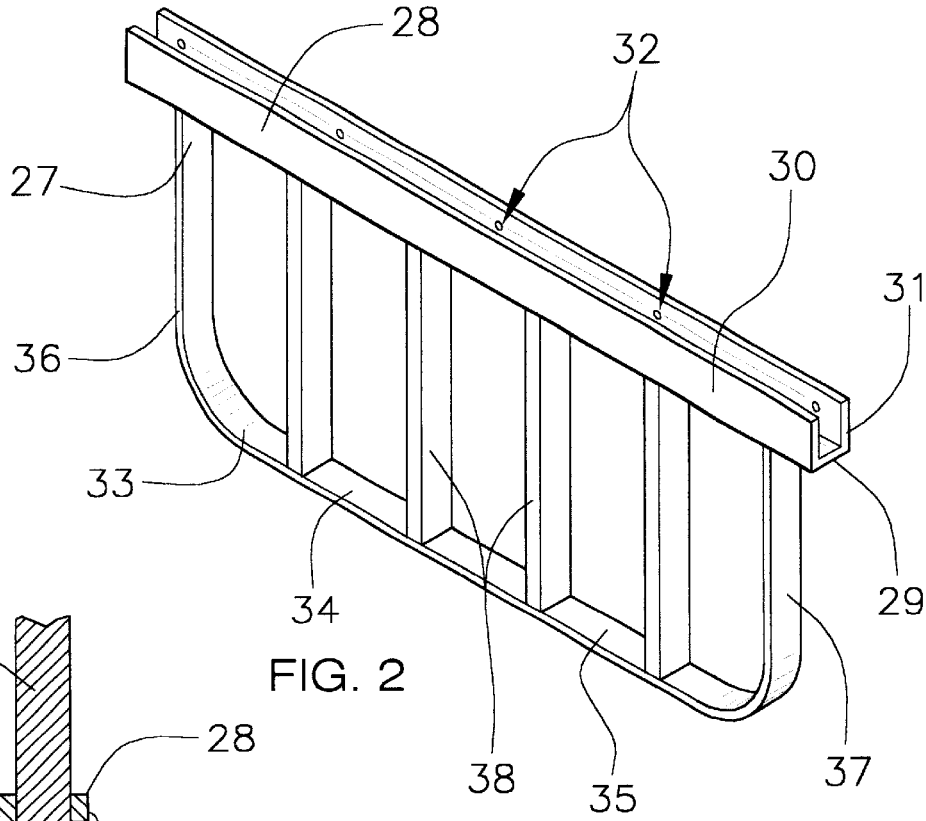
FIG. 2 is a perspective view of the door barrier member of the present invention.
Figure 3:
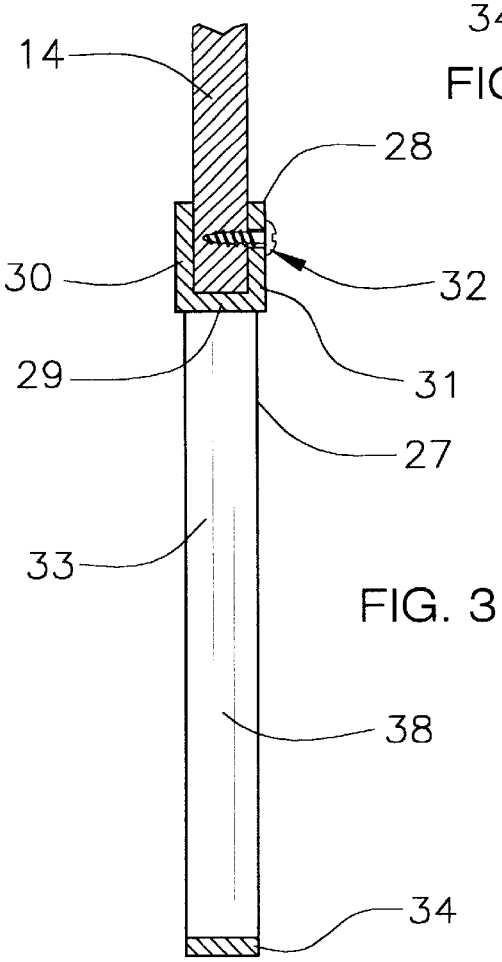
FIG. 3 is a side cross-sectional view of the door barrier member of the present invention.
Figure 4:
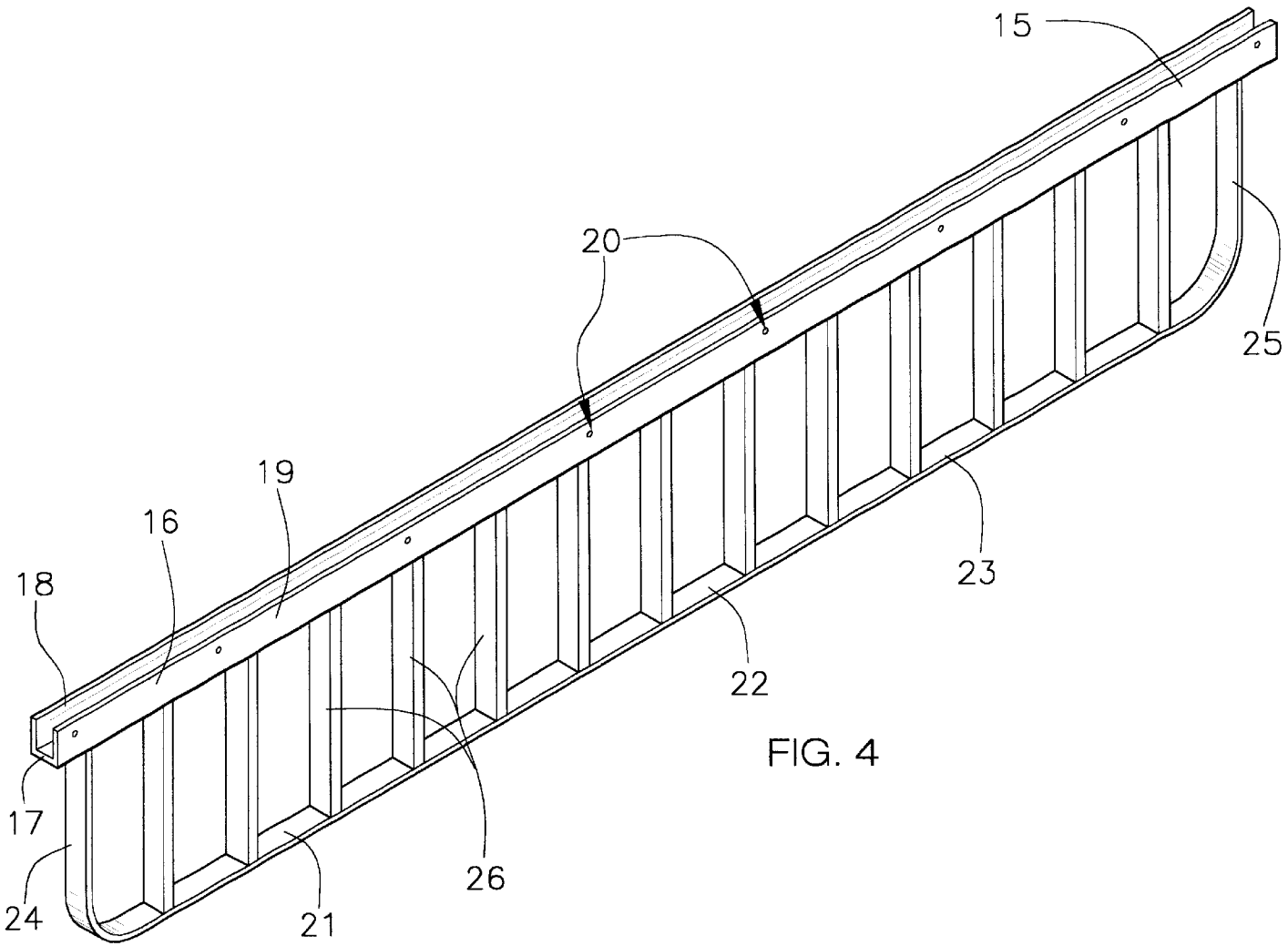
FIG. 4 is a perspective view of the wall barrier member of the present invention.

With reference now to the drawings, and in particular to FIGS. 1 through 4 thereof, a new restroom stall barrier device embodying the principles and concepts of the present invention and generally designated by the reference numeral 10 will be described.

As best illustrated in FIGS. 1 through 4, the restroom stall barrier device 10 generally comprises a restroom stall 11 including support members 12 and also including side walls 13 being securely mounted and fastened to the support members 12 and further includes a door 14 being hingedly attached to one of the side walls 13 with the side walls 13 and the door 14 being suspended above a floor.

Barrier members 15,27 are securely fastened to the side walls 13 and the door 14. The barrier members 15,27 include at least one side wall barrier member 15 having an elongate wall bracket member 16 being fastened with fasteners to and along a bottom edge of a respective side wall 13 of the restroom stall 11, and also include a wall grate member 21 being securely attached and welded to the elongate wall bracket member 16 and being disposed between the elongate wall bracket member 16 and the floor. The elongate wall bracket member 16 has a lateral U-shaped cross-section which includes a bottom wall 17 and side walls 18,19 being spaced apart and extending outwardly from the bottom wall 17 and forming a channel therebetween and also having holes 20 being spacedly disposed therethrough with the bottom edge of the side wall 13 being received and fastened in the channel thereof. The wall grate member 21 is securely attached and welded to the bottom wall 17 of the elongate wall bracket member 16 and includes an elongate wall bar support member 22 having an elongate main portion 23 and curved end portions 24,25 which are securely attached and welded to the bottom wall 17 of the elongate wall bracket member 16, and also includes a plurality of wall bar members 26 being spaced apart and having ends which are securely attached and welded to the elongate wall bracket member 16 and to the elongate wall bar support member 22. The barrier members also include a door barrier member 27 having an elongate door bracket member 28 being fastened with fasteners to and along a bottom edge of the door 14 of the restroom stall 11, and also include a door grate member 33 being securely attached and welded to the elongate door bracket member 28 and being disposed between the elongate door bracket member 28 and the floor. The elongate door bracket member 28 has a lateral U-shaped cross-section which includes a bottom wall 29 and side walls 30,31 being spaced apart and extending outwardly from the bottom wall 29 and forming a channel therebetween and also having holes 30 being spacedly disposed therethrough with the bottom edge of the door 14 being received and fastened in the channel of the elongate door bracket member 28. The door grate member 33 is securely attached and welded to the bottom wall 29 of the elongate door bracket member 28 and includes an elongate door bar support member 34 having an elongate main portion 35 and curved end portions 36,37 which are securely attached and welded to the bottom wall 29 of the elongate door bracket member 28, also includes a plurality of door bar members 38 being spaced apart and having ends which are securely attached and welded to the elongate door bracket member 28 and to the elongate door bar support member 34.

In use, the barrier members 15,27 blocks the space normal found between floor and the side walls 13 and the door 14 of the restroom stall 11 so that a children cannot crawl out of the restroom stall 11 after having purposely locked the door 14 to prevent others from using the restroom stall 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the restroom stall barrier device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A restroom stall barrier device comprising:

a restroom stall including support members and also including side walls being mounted to said support member and further including a door being hingedly attached to one of said side walls, said side walls and said door being suspended above a floor;

barrier members being fastened to said side walls and said door, said barrier members including at least one side wall barrier member having an elongate wall bracket member being fastened with fasteners to and along a bottom edge of a respective said side wall of said restroom stall, and also including a wall grate member being attached to said elongate wall bracket member and being disposed between said elongate wall bracket member and the floor.

2. The restroom stall barrier device as described in claim 1, wherein said elongate wall bracket member has a lateral U-shaped cross-section which includes a bottom wall and side walls being spaced apart and extending outwardly from said bottom wall and forming a channel therebetween and also having holes being spacedly disposed therethrough, said bottom edge of said side wall being received and fastened in said channel.

3. The restroom stall barrier device as described in claim 2, wherein said wall grate member is attached to said bottom wall of said elongate wall bracket member and includes an elongate wall bar support member having an elongate main portion and curved end portions which are securely attached to said bottom wall of said elongate wall bracket member, also includes a plurality of wall bar members being spaced apart and having ends which are attached to said elongate wall bracket member and to said elongate wall bar support member.

4. The restroom stall barrier device as described in claim 3, wherein said barrier members also include a door barrier member having an elongate door bracket member being fastened with fasteners to and along a bottom edge of said door of said restroom stall, and also include a door grate member being attached to said elongate door bracket member and being disposed between said elongate door bracket member and the floor.

5. The restroom stall barrier device as described in claim 4, wherein said elongate door bracket member has a lateral U-shaped cross-section which includes a bottom wall and side walls being spaced apart and extending outwardly from said bottom wall and forming a channel therebetween and also having holes being spacedly disposed therethrough, said bottom edge of said door being received and fastened in said channel of said elongate door bracket member.

6. The restroom stall barrier device as described in claim 5, wherein said door grate member is attached to said bottom wall of said elongate door bracket member and includes an elongate door bar support member having an elongate main portion and curved end portions which are securely attached to said bottom wall of said elongate door bracket member, and also includes a plurality of door bar members being spaced apart and having ends which are attached to said elongate door bracket member and to said elongate door bar support member.

* * * * *